US010727620B2

(12) United States Patent
Vittapalli et al.

(10) Patent No.: US 10,727,620 B2
(45) Date of Patent: Jul. 28, 2020

(54) CONNECTOR ASSEMBLY WITH FOLDED FLAT CABLE

(71) Applicant: 3M INNOVATIVE PROPERTIES COMPANY, St. Paul, MN (US)

(72) Inventors: Rao L. Vittapalli, Singapore (SG); Kok Hoe Lee, Singapore (SG); YunLong Qiao, Singapore (SG); Chin Hua Lim, Singapore (SG); Saujit Bandhu, Singapore (SG)

(73) Assignee: 3M INNOVATIVE PROPERTIES COMPANY, St. Paul, MN (US)

( * ) Notice: Subject to any disclaimer, the term of this patent is extended or adjusted under 35 U.S.C. 154(b) by 0 days.

(21) Appl. No.: 16/203,679

(22) Filed: Nov. 29, 2018

(65) Prior Publication Data

US 2019/0199021 A1 Jun. 27, 2019

Related U.S. Application Data

(60) Provisional application No. 62/608,685, filed on Dec. 21, 2017.

(51) Int. Cl.

| | |
|---|---|
| ***H01R 12/65*** | (2011.01) |
| ***H01R 12/59*** | (2011.01) |
| ***H01R 12/62*** | (2011.01) |
| ***H01R 12/79*** | (2011.01) |

(Continued)

(52) U.S. Cl.

CPC ..... *H01R 12/65* (2013.01); *H01R 12/598* (2013.01); *H01R 12/62* (2013.01); *H01R 12/775* (2013.01); *H01R 12/79* (2013.01); *H01R 13/6658* (2013.01)

(58) Field of Classification Search

CPC ..... H01R 12/65

See application file for complete search history.

(56) References Cited

U.S. PATENT DOCUMENTS 3,296,365 A * 1/1967 Basile ..... H05K 1/118 174/117 FF 3,818,122 A * 6/1974 Luetzow ..... H01B 7/04 174/86

(Continued)

FOREIGN PATENT DOCUMENTS

CN 103514997 1/2014

*Primary Examiner* — Ross N Gushi

(74) *Attorney, Agent, or Firm* — Michael Stern

(57) ABSTRACT

A connector assembly includes first and second connectors. Each connector includes a plurality of terminals A1 through An, n is an integer ≥2, sequentially arranged in a row. The connector assembly also includes a flat cable that includes a plurality of electrical conductors electrically connecting the terminals of the first and second connectors. For each i from 1 to n, terminal Ai of the first connector is electrically connected, via a different electrical conductor of the cable, to the terminal Ai of the second connector. The cable includes a bend greater than about 150° around at least two fold lines that extend across the entire width of the cable. Each of the first and second connectors is configured to mate with the same mating connector, such that when each of the first and second connectors mates with the same mating connector in a same plan view, the An terminals are both either on a left or a right side of the A1 terminals.

27 Claims, 8 Drawing Sheets

(51) Int. Cl.
*H01R 12/77* (2011.01)
*H01R 13/66* (2006.01)

(56) References Cited

U.S. PATENT DOCUMENTS 4,065,199 A * 12/1977 Andre ..... H01B 7/08 439/498
4,068,912 A * 1/1978 Hudson, Jr. ..... H01R 12/675 29/857
4,954,100 A * 9/1990 McCleerey ..... H01B 7/0853 439/492
5,259,792 A * 11/1993 Beck ..... H01R 12/775 439/607.49
5,906,507 A * 5/1999 Howard ..... B65H 75/36 174/135
6,171,139 B1 * 1/2001 Sato ..... H01R 12/724 439/502
6,203,359 B1 * 3/2001 Lee ..... H01R 13/5812 439/405
6,646,207 B1 * 11/2003 Featherstone, III ... H01R 12/73 174/117 F
6,702,607 B2 * 3/2004 Kondo ..... B60R 16/0207 174/72 A
7,507,908 B1 * 3/2009 Wu ..... H01B 7/06 174/110 R
7,601,010 B1 * 10/2009 Wu ..... H01R 13/6658 439/76.1
7,909,661 B2 * 3/2011 Wu ..... H01R 12/721 439/357
8,003,887 B1 * 8/2011 Hsieh ..... H02G 11/006 174/69
8,106,301 B2 * 1/2012 Hsieh ..... H02G 11/006 174/135
8,215,967 B2 * 7/2012 Hsieh ..... H01R 31/06 174/69
8,963,002 B2 * 2/2015 Wang ..... H01B 7/06 174/69
9,130,287 B2 * 9/2015 Tai ..... H01R 13/112
9,306,334 B2 * 4/2016 Zhu ..... H05K 1/0219
9,525,927 B2 * 12/2016 Hu ..... H04R 1/1033
9,722,368 B2 * 8/2017 Kulas ..... H01R 24/58
2005/0247480 A1 * 11/2005 Schulz ..... H01B 7/06 174/117 FF
2009/0104811 A1 * 4/2009 Sumida ..... H01R 25/003 439/501
2011/0297416 A1 * 12/2011 Hsieh ..... H01R 35/025 174/69
2012/0121120 A1 * 5/2012 Gorzelany ..... H02G 3/04 381/384
2012/0156938 A1 * 6/2012 Zhang ..... H01R 24/60 439/660
2018/0205181 A1 * 7/2018 Chen ..... H01R 13/6585

* cited by examiner

CONNECTOR ASSEMBLY WITH FOLDED FLAT CABLE

FIELD OF THE DISCLOSURE

This disclosure relates to folded flat cables for connector assemblies.

BACKGROUND

A variety of different techniques have been developed for connecting electronic systems. As the electronic systems have become more complex, so have the articles to connect them. An example of an electronic system that utilizes complex connections are circuit boards. Circuit boards are often electrically connected to another electrical component using an electrical cable which includes a plurality of parallel insulated conductors. Conventionally, the electrical cable is then attached to another connector.

SUMMARY

Disclosed herein are connector assemblies. In some embodiments, the connector assembly comprises first and second connectors, and substantially flat first and second cables comprising a plurality of electrical conductors connecting them. Each connector comprises an insulative housing comprising a mating end for mating with a mating connector and an opposing cable end for receiving one or more cables, and a circuit board at least partially disposed within the insulative housing. The circuit board comprises an upper surface and an opposing lower surface, a mating section at a front end of the circuit board and a termination section at a rear end of the circuit board and disposed at the cable end of the insulative housing. The mating section of the circuit board comprises a plurality of mating terminals on each of the upper and lower surfaces for making contact with corresponding terminals of a mating connector, the mating terminals comprising A terminals A1 through An, where n is an integer ≥2, sequentially arranged on the upper surface and B terminals B1 through Bn, sequentially arranged on the lower surface, terminal Ai, for each i from 1 to n, corresponding to and aligned with terminal Bi, the A1 and An terminals of the first connector having a same positional relationship as the A1 and An terminals of the second connector. The termination section at a rear end of the circuit board comprises a plurality of termination terminals on each of the upper and lower surfaces electrically connected to the mating terminals. The substantially flat first and second cables comprise a plurality of electrical conductors terminated at the termination terminals of the first and second connectors such that for each i from 1 to n, terminal Ai of the first connector is electrically connected, via a different electrical conductor of the first cable, to the terminal Ai of the second connector, and terminal Bi of the first connector is electrically connected, via a different electrical conductor of the second cable, to the terminal Bi of the second connector. Each cable includes a bend angle greater than about 150° around at least two fold lines that extend across an entire width of the cable.

In other embodiments of connector assemblies of this disclosure, the connector assembly comprises first and second connectors, and a flat cable comprising a plurality of electrical conductors. Each connector comprises a plurality of terminals A1 through An, where n is an integer ≥2, sequentially arranged in a row. The flat cable comprising a plurality of electrical conductors electrically connects the terminals of the first and second connectors, such that for each i from 1 to n, terminal Ai of the first connector is electrically connected, via a different electrical conductor of the cable, to the terminal Ai of the second connector. The cable has a bend angle greater than about 150° around at least two fold lines that extends across an entire width of the cable. Each of the first and second connectors is configured to mate with a same mating connector, such that when each of the first and second connectors mates with the same mating connector in a same plan view, the An terminals are both either on a left or a right side of the A1 terminals.

BRIEF DESCRIPTION OF THE DRAWINGS

The present application may be more completely understood in consideration of the following detailed description of various embodiments of the disclosure in connection with the accompanying drawings.

Figure 1:
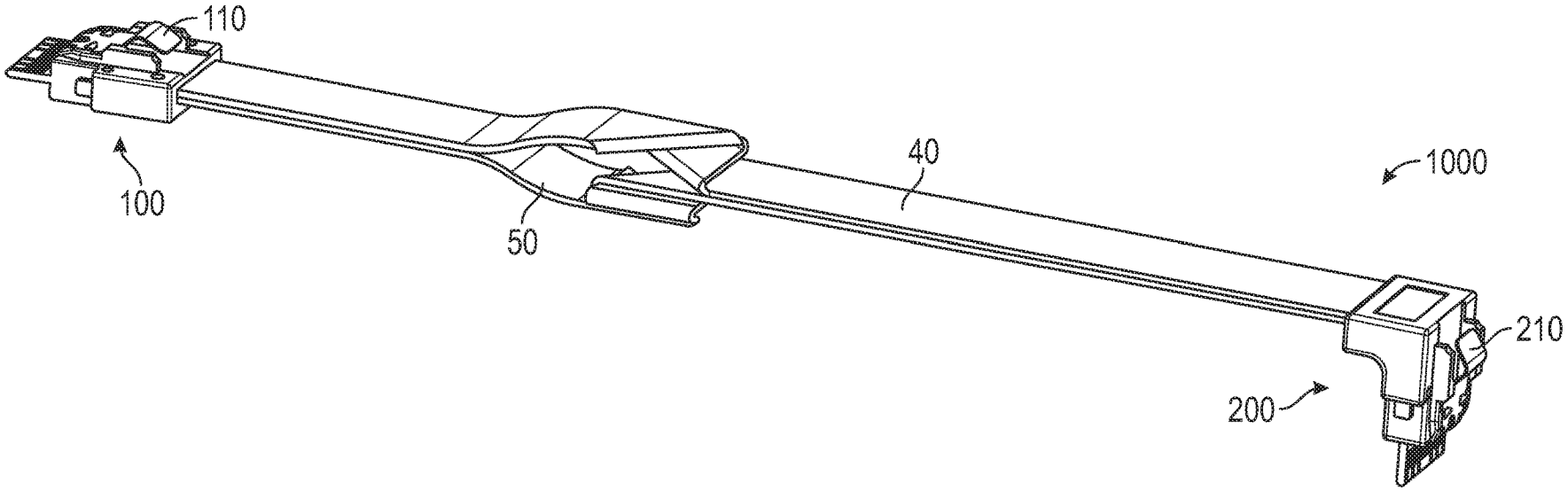
FIG. 1 shows a plan view of an embodiment of a connector assembly of this disclosure.

In the following description of the illustrated embodiments, reference is made to the accompanying drawings, in which is shown by way of illustration, various embodiments in which the disclosure may be practiced. It is to be understood that the embodiments may be utilized and structural changes may be made without departing from the scope of the present disclosure. The figures are not necessarily to scale. Like numbers used in the figures refer to like components. However, it will be understood that the use of a number to refer to a component in a given figure is not intended to limit the component in another figure labeled with the same number.

DETAILED DESCRIPTION

Circuit boards are often electrically connected to another electrical component using an electrical cable which includes a plurality of parallel insulated conductors. Often the circuit board is housed in a connector assembly with a mating end for mating to a mating connector and an opposing cable end for receiving one or more cables.

One difficulty that has been encountered in the assembly of electrical components, where an assembly of the type: connector 1/cable/connector 2, is that because connector 1 and connector 2 have arrays of elements that must be connected together in the proper order to provide the correct electrical connection, the arrays of the two connectors cannot be identical but rather must be mirror images of one another. This can be easily visualized through the concept of "handedness". If one turns the palms of the hands toward each other places together the left hand and the right hand, each of the fingers on the left hand aligns with corresponding finger on the right hand. This is because the hands are not identical but are mirror images of each other. If instead of this, one had two left hands and turned the palms toward each other and placed the hands together, one would see that the fingers now do not align with each other. Using this handedness illustration with the connector 1/cable/connector 2 assembly, one can see that the two connectors are facing each other in a way that is analogous to the palms of the hands facing each other. Therefore, in order for the arrays of elements of the connectors to align with each other (analogous to the alignment of the fingers of the hands), one needs a "left hand connector" and a "right hand connector". Again using the handedness analogy, if one attempted to connect together two left hand connectors, the arrays of elements would not align properly.

There are however circumstances where one does not wish to manufacture "left hand connectors" and "right hand connectors" but rather wishes to manufacture only one type of connector. Also, the assemblers of electronic devices may not wish to inventory two different types of connectors when manufacturing devices. Therefore a method for preparing connector assemblies with two connectors that are the same, i.e. have the same handedness is desirable.

This disclosure describes connector assemblies that contain two connectors that have the same handedness, that is to say, the arrays of elements in the two connectors are the same and not mirror images of each other. In this disclosure, methods of folding substantially flat cables which contain a plurality of parallel insulated conductors such that two connectors can be connected when the two connectors have identical arrays of elements, or to use the handedness analogy, two connectors can be connected when both of the connectors are of the same handedness (i.e. both are "left handed connectors"). In other words, in the connector assembly, each of the first and second connectors is configured to mate with a same mating connector.

FIG. 1 shows a connector assembly 1000, comprising first connector 100 and second connector 200, with substantially flat first cable 40 and second cable 50 connecting them. The substantially flat first cable 40 and second cable 50 contain a folded portion that is described in detail below. Connector 100 has latch 110 and connector 200 has latch 210.

Figure 2:
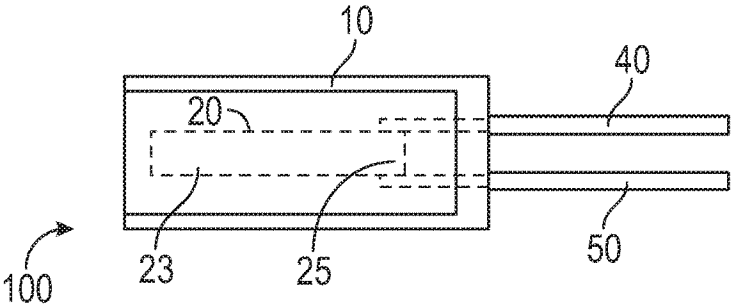
FIG. 2 shows a cross-sectional view of an embodiment of a first or second connector of a connector assembly of this disclosure.
Figure 3:
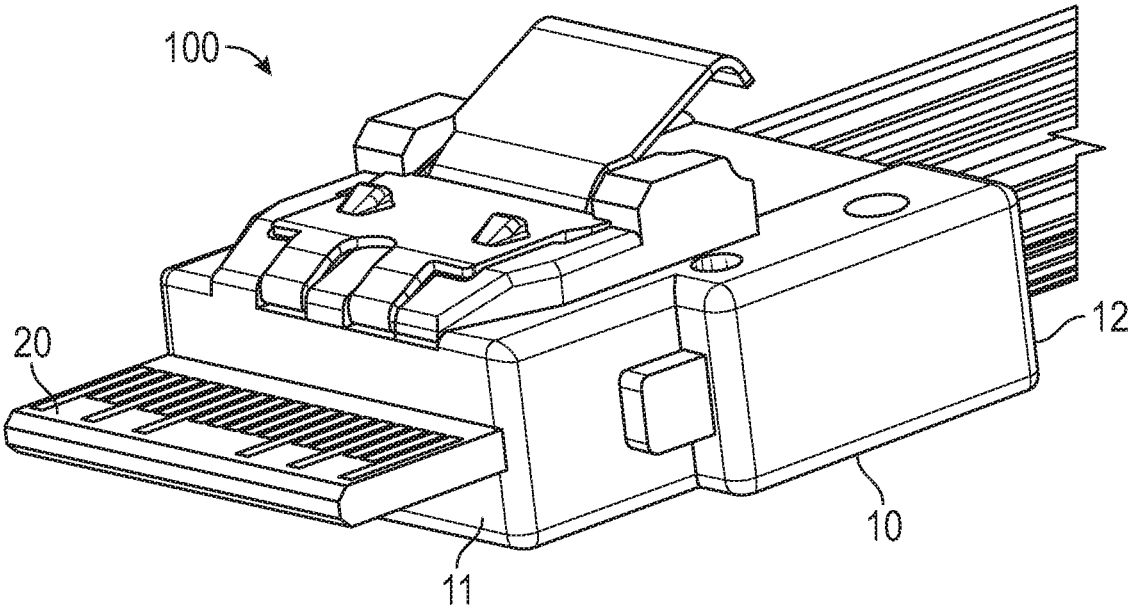
FIG. 3 shows a plan view of an embodiment of a first or second connector of a connector assembly of this disclosure.

FIGS. 2 and 3 show details of two different embodiments of connector 100. In FIG. 2, the first embodiment of connector 100, the circuit board 20 of the connector is fully enclosed by an insulative housing 10. Circuit board 20 has a mating section 23 at a front end and a termination section 25 at a rear end disposed at the cable end of the insulative housing. Substantially flat first cable 40 and second cable 50 are in electrical contact with termination section 25 of the circuit board 20.

In FIG. 3, the second embodiment of connector 100, the circuit board 20 is not fully enclosed by the insulative housing 10, but rather is only partially enclosed. In FIG. 3, insulative housing 10 comprises a mating end 11 for mating with a mating connector and an opposing cable end 12 for receiving one or more cables. Greater detail of connector 100 with insulative housing 10 removed for clarity is shown in FIGS. 4*a* and 4*b*, FIG. 4*a* showing a top view and FIG. 4*b* showing a bottom view of connector 100 with insulative housing 10 removed for clarity.

Figure 4A:
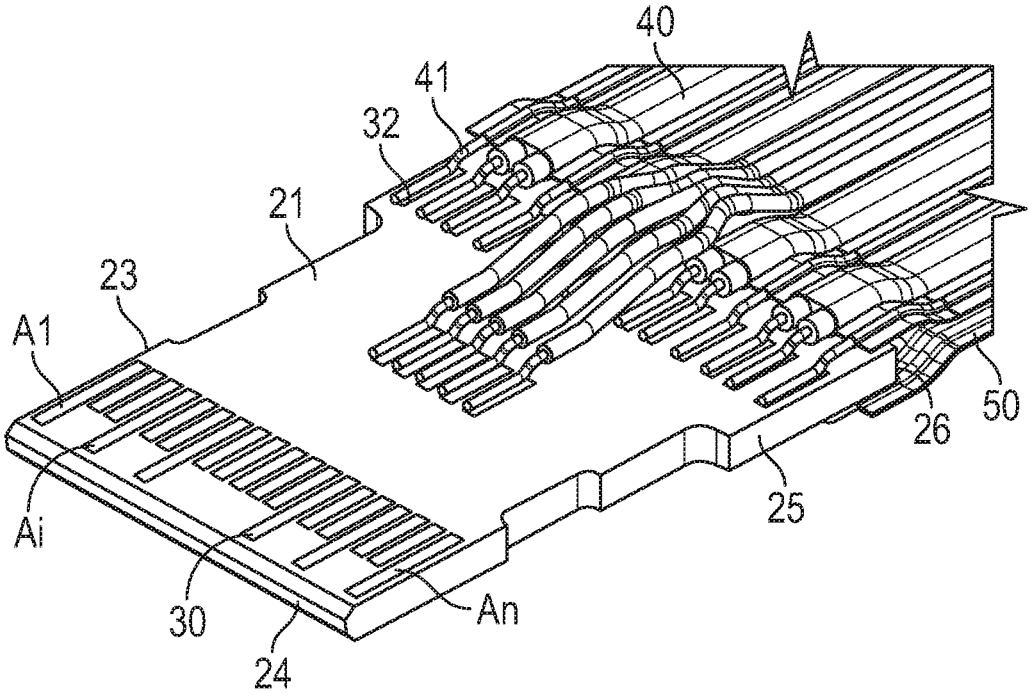
FIGS. 4*a* and 4*b* show plan views of an embodiment of a first or second connector without the insulative housing, of a connector assembly of this disclosure.
Figure 4B:
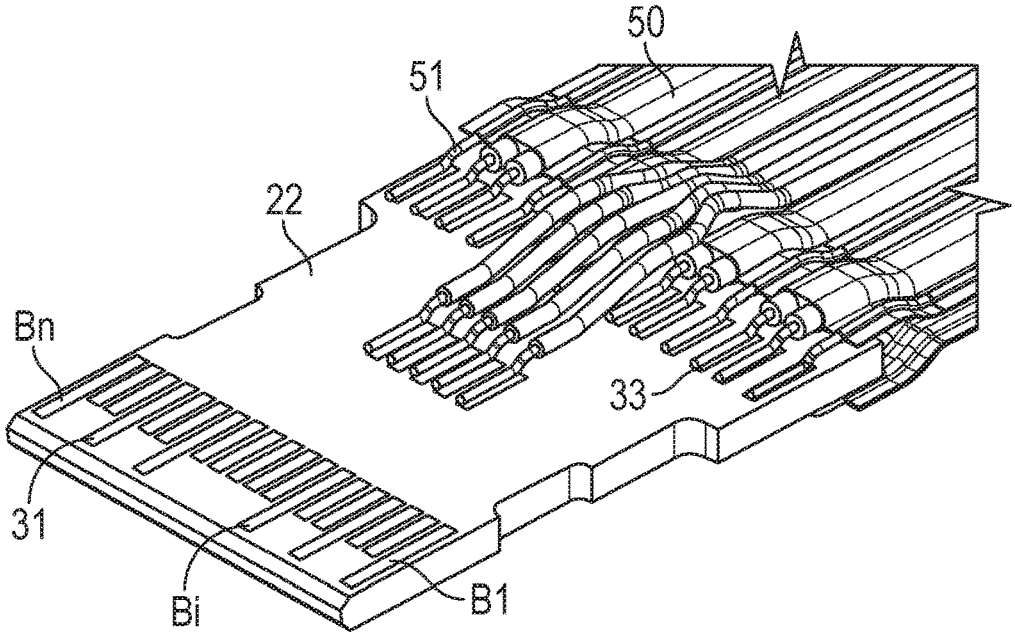

FIGS. 4*a* and 4*b* show an upper surface 21 and an opposing lower surface 22, a mating section 23 at a front end 24 of the circuit board, the mating section comprising a plurality of mating terminals 30, 31 on each of the upper and lower surfaces for making contact with corresponding terminals of a mating connector. The mating terminals comprise A terminals A1 through An, where n is an integer ≥2, sequentially arranged on the upper surface and B terminals B1 through Bn, sequentially arranged on the lower surface. The terminal Ai, for each i from 1 to n, corresponds to and is aligned with terminal Bi. Termination section 25 at a rear end 26 of the circuit board is disposed at the cable end of the insulative housing. The termination section 25 comprises a plurality of termination terminals 32, 33 on each of the upper and lower surfaces electrically connected to the mating terminals. Substantially flat first 40 and second 50 cables comprising a plurality of electrical conductors 41, 51 terminated at the termination terminals. In some embodiments, n is an integer ≥10.

It should be noted that connector 200 has the same positional relationship of terminals A1 and An and B1 and Bn as shown in connector 100, such that for each i from 1 to n, terminal Ai of the first connector is electrically connected, via a different electrical conductor of the first cable, to the terminal Ai of the second connector, and terminal Bi of the first connector is electrically connected, via a different electrical conductor of the second cable, to the terminal Bi of the second connector. Connector 200 shown in FIG. 1 is a right angle connector, meaning that the mating end and cable end of the connector are not linearly arranged, but are at a right angle (90°) to each other. Connector 200 need not be a right angle connector, but may be a connector identical to connector 100.

In some embodiments of the connector assembly, the mating terminals on each of the upper and lower surfaces of circuit board are arranged in a single row. Also in some embodiments of the connector assembly, the termination terminals on each of the upper and lower surfaces of circuit board are arranged in a single row.

In other embodiments of the connector assembly, the termination terminals on each of the upper and lower surfaces of circuit board are arranged in two rows. In some embodiments, the first and second connectors mate with the same connector in a same plan view, where the An and Bn terminals are on a left side of the respective A1 and B1 terminals. In other embodiments, the first and second connectors mates with the same connector in a same plan view, where the An and Bn terminals are on a right side of the respective A1 and B1 terminals.

Figure 5A:
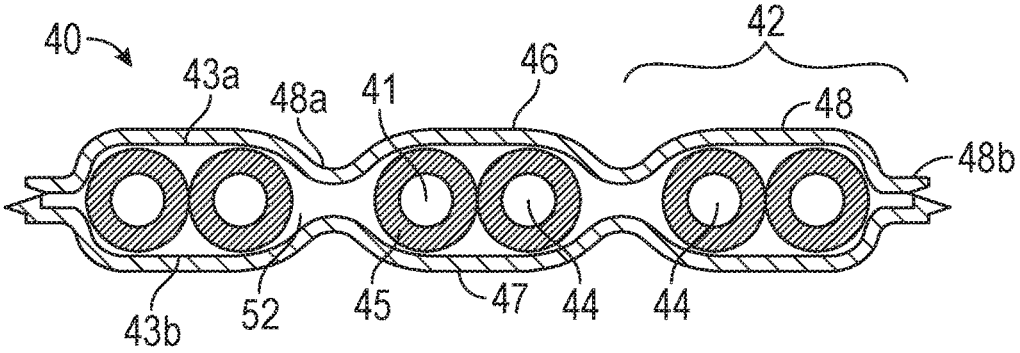
FIGS. 5*a* and 5*b* show cross-sectional views of embodiments of a first or second cable of a connector assembly of this disclosure.
Figure 5B:
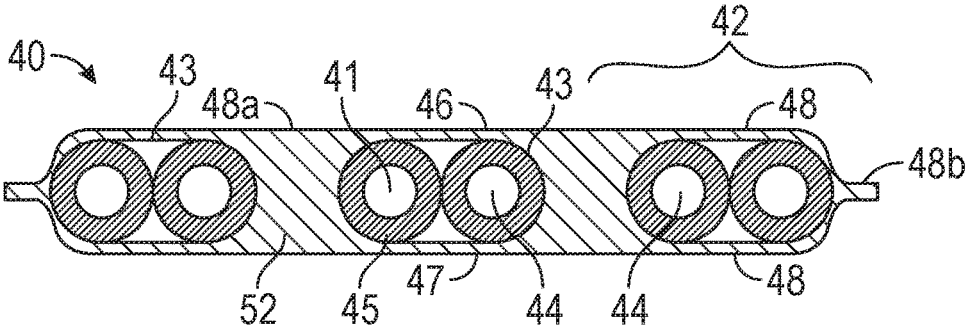

FIGS. 5*a* and 5*b* show cross sectional views of two embodiments of cable 40. Either of these embodiments of cable can also be used for cable 50. Therefore in FIGS. 5*a* and 5*b*, each of the numerals used to designate an element in cable 40 can likewise be used to designate an element in corresponding cable 50. For example electrical conductor 41 in cable 40 corresponds with electrical conductor 51 in cable 50. In FIGS. 5*a* and 5*b*, electrical cable 40 includes a plurality of conductor sets 42 which extend lengthwise (in the x direction) of the cable, comprising pairs of substantially parallel insulated conductors 41 and electrically conductive shield 48. Each insulated conductor in the plurality of insulated conductors 41 includes a central conductor 44 and a dielectric layer 45. Each conductor pair is surrounded by an electrically conductive shield shown as 43 in FIG. 5*b*, and as 43*a* and 43*b* in FIG. 5*a*. First (46) and second (47)

non-conductive polymer layers are disposed on opposite sides of the cable forming electrically conductive shield 48. The conductive shield 48 has cover portions 48*a* and pinched portions 48*b*. The cable further comprises adhesive layer 52 disposed between layers 46 and 47 and holding the two layers together.

Figure 6:
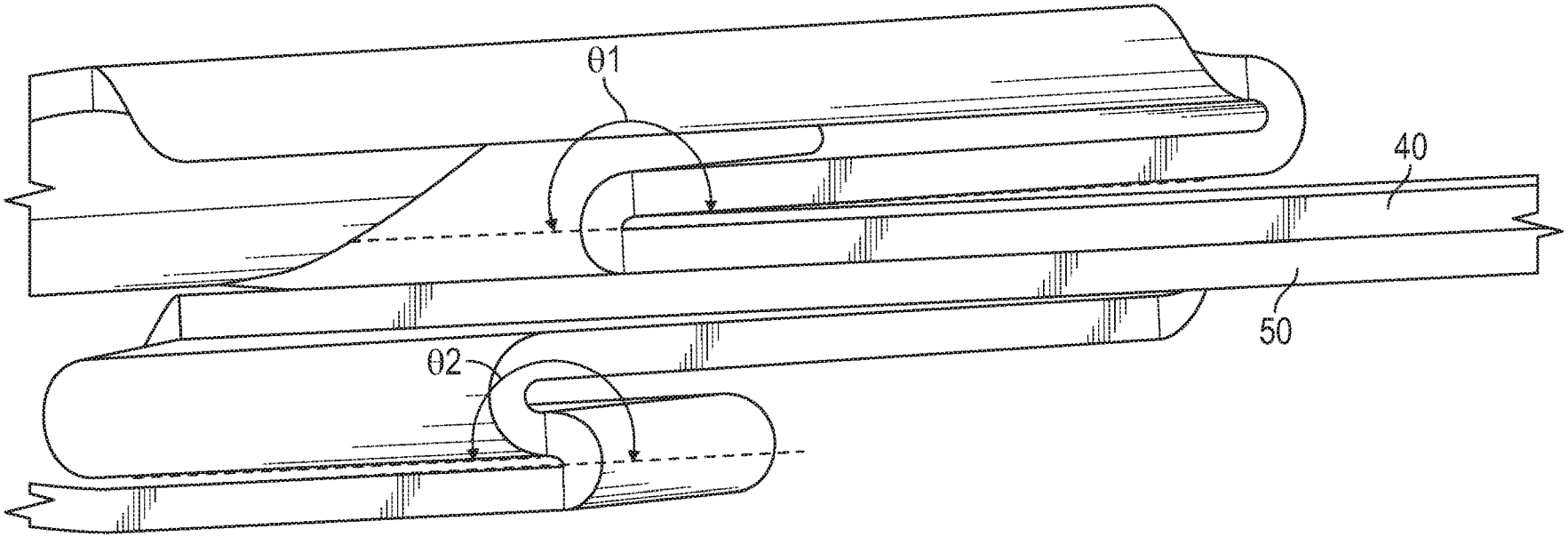
FIG. 6 shows a cross-sectional view of an embodiment of the folds of the cables of a connector assembly of this disclosure.
Figure 7A:
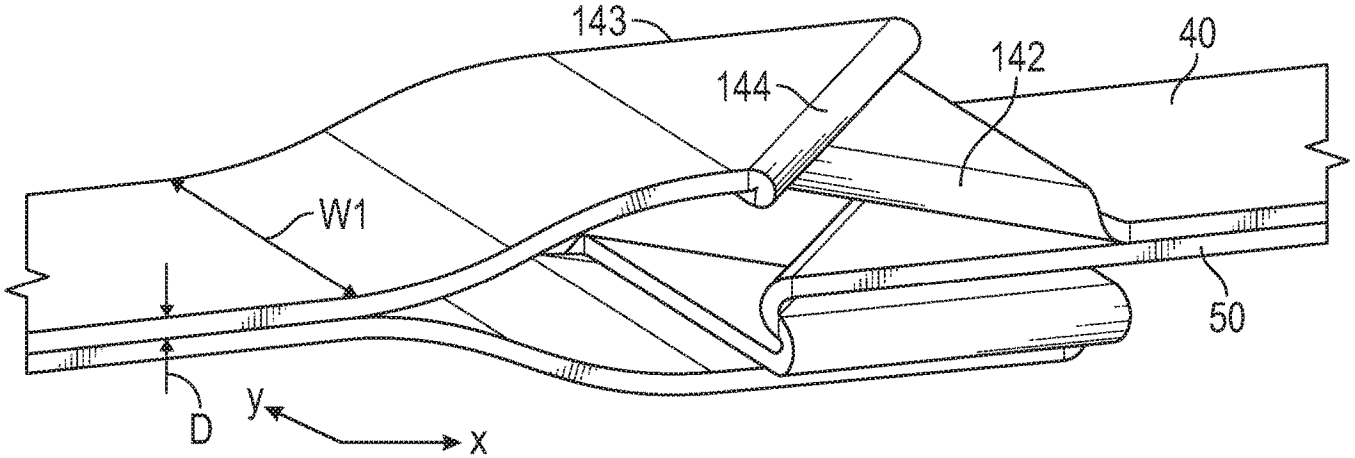
FIGS. 7*a*-7*d* show plan views of embodiments of the folds of the cables of a connector assembly of this disclosure.
Figure 7B:
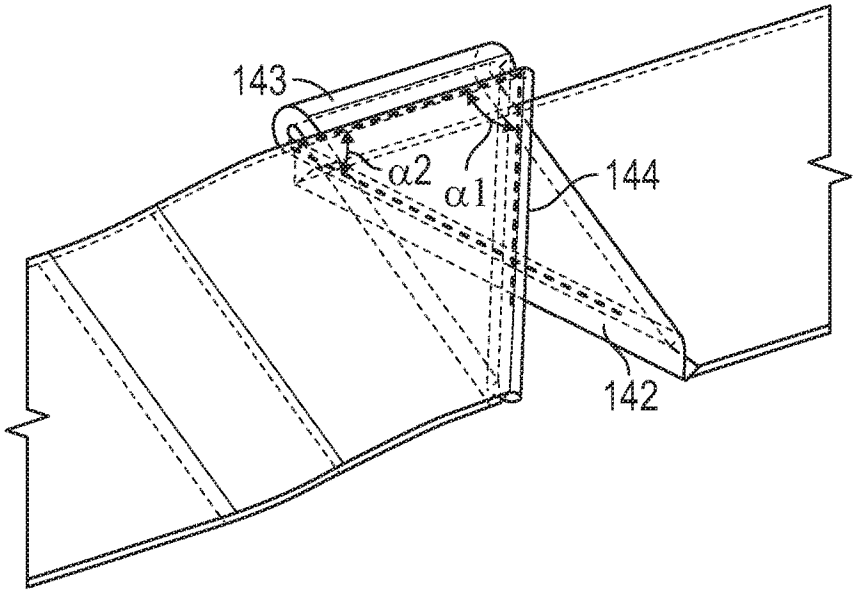
Figure 7C:
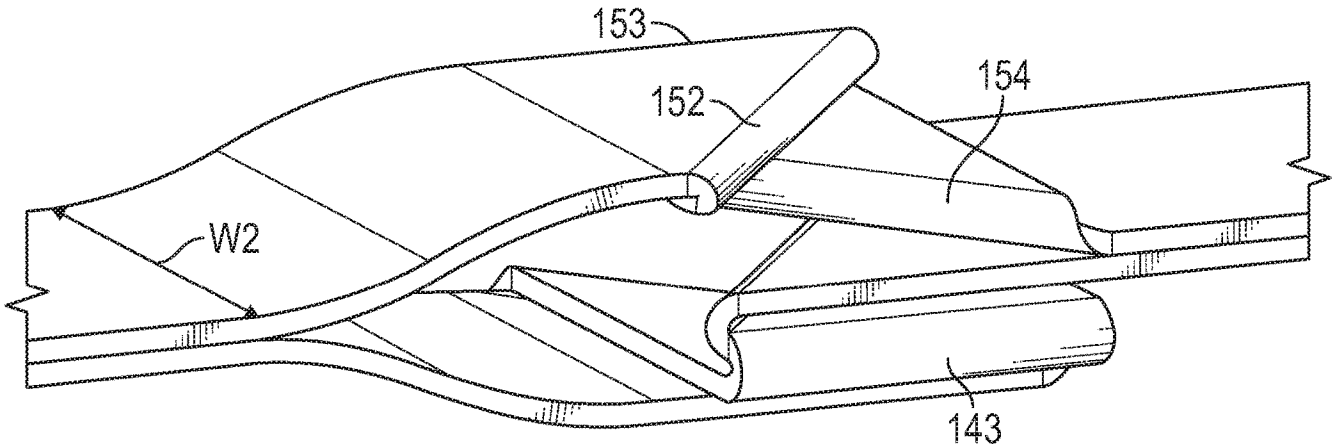
Figure 7D:
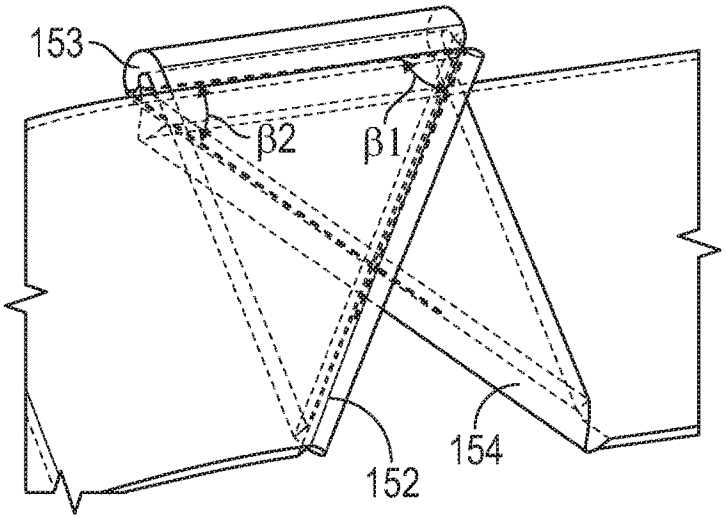
Figure 8:
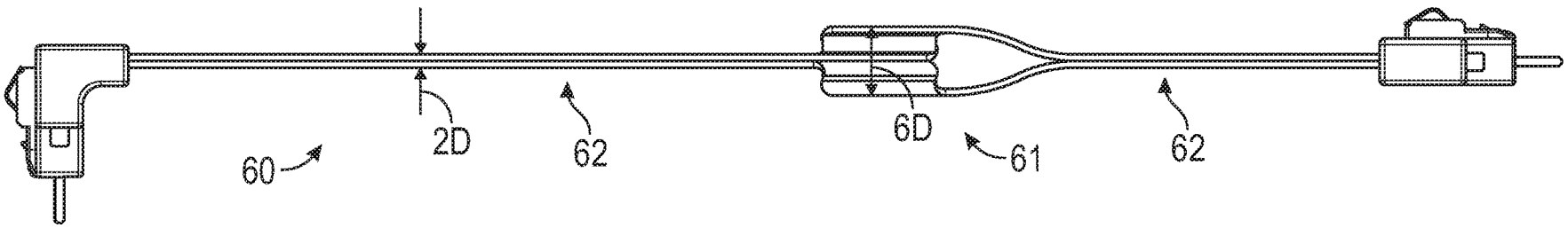
FIG. 8 shows a plan view of an embodiment of a connector assembly of this disclosure.
Figure 9:
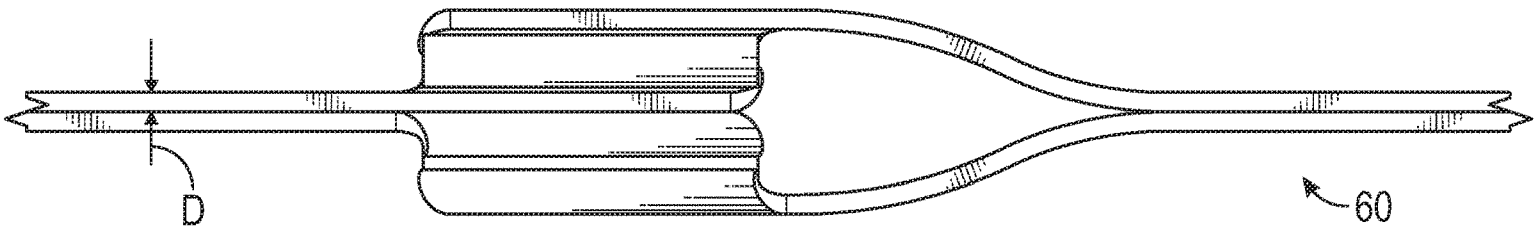
FIG. 9 shows a plan view of the folded region of an embodiment of a connector assembly of this disclosure.

As was mentioned above, the connector assembly 1000 shown in FIG. 1 includes a folded portion in the cable 40 and 50. The folded portion is further shown in FIGS. 6, 7*a-d*, 8, and 9. As shown in FIG. 6, each cable 40 and 50 includes a bend angle, θ1 for cable 40 and θ2 for cable 50, that is greater than about 150° around at least two fold lines. The fold lines are shown in FIGS. 7*a*-7*d*, and are 142-144 for cable 40 and 152-154 for cable 50. The fold lines extend across an entire width of the cable, the widths are shown as W1 for cable 40, and W2 for cable 50. In some embodiments, the bend angle θ1 for cable 40 and θ2 for cable 50, that is greater than about 160° around at least two fold lines. In some embodiments, the bend angle θ1 for cable 40 and θ2 for cable 50, that is greater than about 170° around at least two fold lines. In some particularly desirable embodiments, the bend angle θ1 for cable 40 and θ2 for cable 50, is about 180° around at least two fold lines. As shown in FIGS. 7*b* and 7*d*, the flat first and second cables define orthogonal length (x) and width (y) directions along the respective lengths and widths of the cables, wherein in a plan view and for each cable, one of the fold lines 143 for cable 40 and 153 for cable 50, is parallel to the length direction of the cable, and the other two fold lines 142 and 144 for cable 40 make oblique angles α1 and α2 with the length direction of the cable, and the other two fold lines 152 and 154 for cable 50 make oblique angles β1 and β2 with the length direction of the cable. In some embodiments, the oblique angles α1, α2, β1, and β2 are between 30° to 70°. In other embodiments, the oblique angles α1, α2, β1, and β2 are about 45°. In some embodiments, the bends of the first and second cable are generally located at a same position along the length of the cables. As shown in FIGS. 8 and 9, each cable has an average thickness D, wherein the first and second cables, in combination, form a cable stack 60 having a fold region 61 where the first and second cables are bent, and an unfold region 62 on each side of the fold region where the first and second cables are not bent. The average thickness of the cable stack is approximately 2D in the unfold regions, and 6D to 7D in the fold region. In some embodiments, the average thickness of the cable stack is approximately 6D in the fold region. Typically, the fold region comprises three folds, such that the non-fold regions 62 are in a linear relationship with each other.

Figure 10:
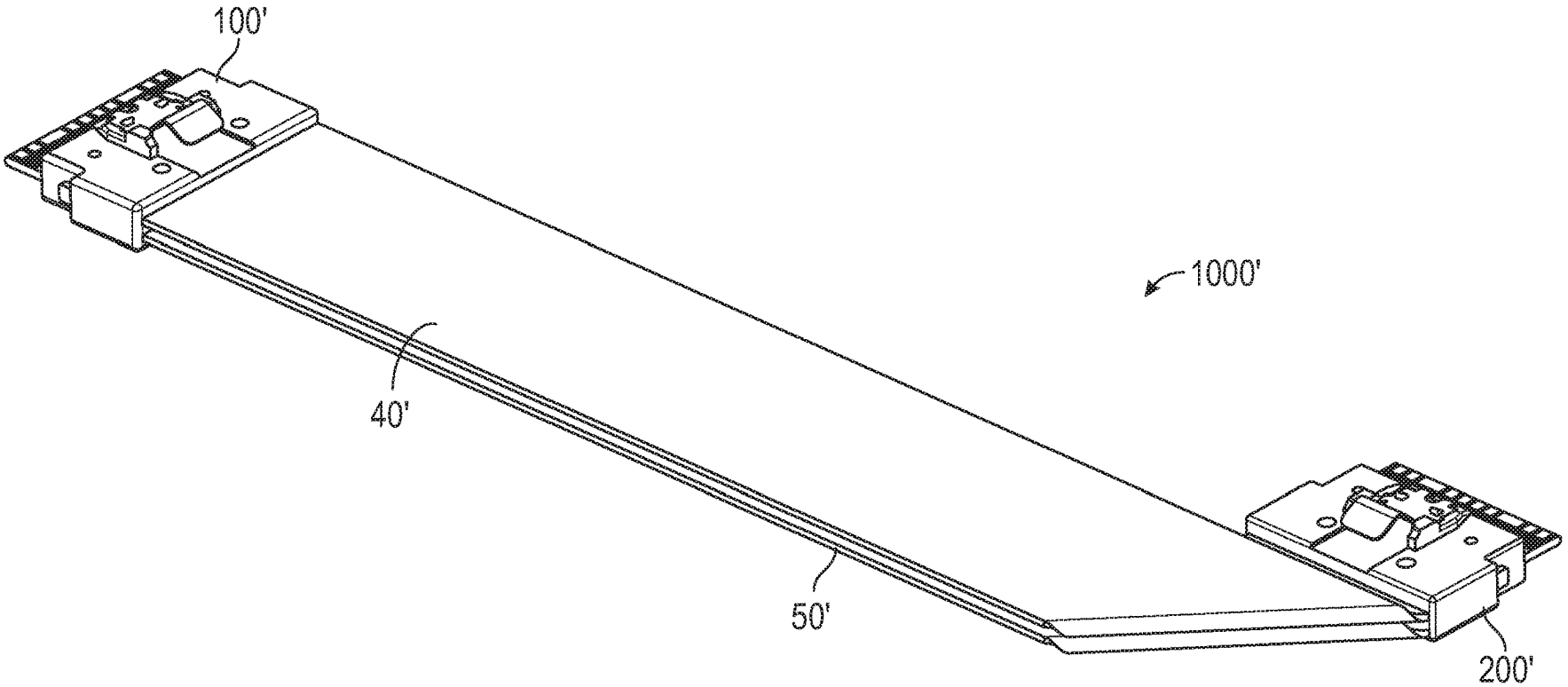
FIG. 10 shows a plan view of another embodiment of a connector assembly of this disclosure.

FIG. 10 shows an alternative embodiment of connector assembly shown in FIG. 1. In FIG. 10, connector 1000' has first connector 100' and second connector 200' connected by cable 40' and cable 50'. This embodiment is different from the embodiment of FIG. 1 in that the cables 40' and 50' only have a single fold. In this way the connectors 100' and 200' are orthogonal to one another instead of facing each other. In all other ways the connector 100' is as described for connector 100, connector 200' is as described for connector 200, cable 40' is as described for cable 40, and cable 50' is as described for cable 50.

In an alternative embodiment of the connector assembly of FIG. 1, wherein the connector assembly comprises just cable 40 without cable 50, i.e. cable 50 is optional. In this embodiment, the connector assembly comprises first connector 100 and second connector 200, where each connector 100 comprising a plurality of terminals A1 through An, where n is an integer ≥2, sequentially arranged in a row, and a substantially flat cable 40 comprising a plurality of electrical conductors 41 electrically connecting the terminals of the first and second connectors, such that for each i from 1 to n, terminal Ai of the first connector is electrically connected, via a different electrical conductor of the cable, to the terminal Ai of the second connector. As with the embodiment described above, the cable comprises a bend angle θ1 of greater than about 150° around at least two fold lines 142-144 that extend across an entire width W1 of the cable. Each of the first and second connectors is configured to mate with a same mating connector, such that when each of the first and second connectors mates with the same mating connector in a same plan view, the An terminals are both either on a left or a right side of the A1 terminals.

The present disclosure includes the following embodiments:

Among the embodiments are connector assemblies. Embodiment 1 is a connector assembly comprising: first and second connectors, each connector comprising: an insulative housing comprising a mating end for mating with a mating connector and an opposing cable end for receiving one or more cables; and a circuit board at least partially disposed within the insulative housing and comprising: an upper surface and an opposing lower surface; a mating section at a front end of the circuit board the mating section comprising a plurality of mating terminals on each of the upper and lower surfaces for making contact with corresponding terminals of a mating connector, the mating terminals comprising A terminals A1 through An, where n is an integer ≥2, sequentially arranged on the upper surface and B terminals B1 through Bn, sequentially arranged on the lower surface, terminal Ai, for each i from 1 to n, corresponding to and aligned with terminal Bi, the A1 and An terminals of the first connector having a same positional relationship as the A1 and An terminals of the second connector; and a termination section at a rear end of the circuit board and disposed at the cable end of the insulative housing, the termination section comprising a plurality of termination terminals on each of the upper and lower surfaces electrically connected to the mating terminals; and substantially flat first and second cables comprising a plurality of electrical conductors terminated at the termination terminals of the first and second connectors such that for each i from 1 to n, terminal Ai of the first connector is electrically connected, via a different electrical conductor of the first cable, to the terminal Ai of the second connector, and terminal Bi of the first connector is electrically connected, via a different electrical conductor of the second cable, to the terminal Bi of the second connector, wherein each cable includes a bend angle greater than about 150° around at least two fold lines that extend across an entire width of the cable.

Embodiment 2 is the connector assembly of embodiment 1, wherein both the first connector and the second connector are straight connectors.

Embodiment 3 is the connector assembly of embodiment 1, wherein the first connector is a straight connector and the second connector is a right-angle connector.

Embodiment 4 is the connector assembly of any of embodiments 1-3, wherein at least one of the first and second connector comprises a latch for latching the connector to a mating connector.

Embodiment 5 is the connector assembly of any of embodiments 1-4, wherein the circuit board is partially disposed in the insulative housing and the mating section of the circuit board extends forwardly from the mating end of the insulative housing.

Embodiment 6 is the connector assembly of any of embodiments 1-4, wherein the circuit board is fully disposed in the insulating housing so that both the mating section and the termination sections of the circuit board are fully disposed within the insulative housing.

Embodiment 7 is the connector assembly of any of embodiments 1-6, wherein the mating terminals on each of the upper and lower surfaces of circuit board are arranged in a single row.

Embodiment 8 is the connector assembly of any of embodiments 1-7, wherein the termination terminals on each of the upper and lower surfaces of circuit board are arranged in a single row.

Embodiment 9 is the connector assembly of any of embodiments 1-6, wherein the termination terminals on each of the upper and lower surfaces of circuit board are arranged in two rows.

Embodiment 10 is the connector assembly of any of embodiments 1-9, wherein some of the mating terminals are longer than some of the other mating terminals.

Embodiment 11 is the connector assembly of any of embodiments 1-10, wherein at least one of the flat first and second cables comprises: a plurality of conductor sets extending lengthwise along the cable and arranged generally in a plane along a width of the cable, each conductor set substantially surrounded by an electrically conductive shield and including two insulated conductors, each insulated conductor comprising a central conductor surrounded by a plurality of dielectric layer; and first and second non-conductive polymeric layers disposed on opposite sides of the cable, the first and second polymeric layers including cover portions and pinched portions arranged such that, in a transverse cross section, the cover portions of the first and second polymeric layers in combination substantially surround the plurality of conductor sets, and the pinched portions of the first and second polymeric layers in combination form pinched portions of the cable on each side of the cable.

Embodiment 12 is the connector assembly of embodiment 11, wherein the shield comprises first and second shielding layers disposed on opposite sides of the cable, the first shield adhered and conforming to the first non-conductive polymeric layer, the second shield adhered and conforming to the second non-conductive polymeric layer.

Embodiment 13 is the connector assembly of embodiment 11 or 12, wherein the at least one of the flat first and second cables further comprises an adhesive layer disposed between the first and second polymeric layers and bonding the two polymeric layers in the pinched portions of the cable.

Embodiment 14 is the connector assembly of any of embodiments 11-13, wherein the pinched portions of the first and second polymeric layers in combination form pinched portions of the cable on each side of each conductor set.

Embodiment 15 is the connector assembly of any of embodiments 1-14, wherein n is an integer ≥10.

Embodiment 16 is the connector assembly of any of embodiments 1-15, wherein each of the first and second connectors is configured to mate with a same mating connector.

Embodiment 17 is the connector assembly of any of embodiments 1-16, wherein when each of the first and second connectors mates with the same connector in a same plan view, the An and Bn terminals are on a left side of the respective A1 and B1 terminals.

Embodiment 18 is the connector assembly of any of embodiments 1-16, wherein when each of the first and second connectors mates with the same connector in a same plan view, the An and Bn terminals are on a right side of the respective A1 and B1 terminals.

Embodiment 19 is the connector assembly of any of embodiments 1-18, wherein the bend angle is greater than about 160°.

Embodiment 20 is the connector assembly of any of embodiments 1-18, wherein the bend angle is greater than about 170°.

Embodiment 21 is the connector assembly of any of embodiments 1-18, wherein the bend angle is about 180°.

Embodiment 22 is the connector assembly of any of embodiments 1-21, wherein each cable includes one fold extending across the entire width of the cable.

Embodiment 23 is the connector assembly of any of embodiments 1-21, wherein each cable includes three folds, each fold extending across the entire width of the cable.

Embodiment 24 is the connector assembly of any of embodiments 1-23, wherein the flat first and second cables define orthogonal length and width directions along the respective lengths and widths of the cables, wherein in a plan view and for each cable, one of the fold lines is parallel to the length direction of the cable, and the other two fold lines make oblique angles with the length direction of the cable.

Embodiment 25 is the connector assembly of embodiment 24, wherein the oblique angles are between 30 to 70 degrees.

Embodiment 26 is the connector assembly of embodiment 24, wherein the oblique angles are about 45 degrees.

Embodiment 27 is the connector assembly of any of embodiments 1-26, wherein the bends of the first and second cable are generally located at a same position along the length of the cables.

Embodiment 28 is the connector assembly of any of embodiments 1-27, wherein each cable has an average thickness D, wherein the first and second cables, in combination, form a cable stack having a fold region where the first and second cables are bent, and an unfold region on each side of the fold region where the first and second cables are not bent, wherein an average thickness of the cable stack is approximately 2D in the unfold regions, and 6D to 7D in the fold region.

Embodiment 29 is the connector assembly of embodiment 28, wherein the average thickness of the cable stack is approximately 6D in the fold region.

Embodiment 30 is a connector assembly comprising: first and second connectors, each connector comprising a plurality of terminals A1 through An, where n is an integer ≥2, sequentially arranged in a row; and a flat cable comprising a plurality of electrical conductors electrically connecting the terminals of the first and second connectors, such that for each i from 1 to n, terminal Ai of the first connector is electrically connected, via a different electrical conductor of the cable, to the terminal Ai of the second connector, the cable comprising a bend angle greater than about 150° around at least two fold lines that extend across an entire width of the cable, wherein each of the first and second connectors is configured to mate with a same mating connector, such that when each of the first and second connectors mates with the same mating connector in a same plan view, the An terminals are both either on a left or a right side of the A1 terminals.

Embodiment 31 is the connector assembly of embodiment 30, wherein both the first connector and the second connector are straight connectors.

Embodiment 32 is the connector assembly of embodiment 30, wherein the first connector is a straight connector and the second connector is a right-angle connector.

Embodiment 33 is the connector assembly of any of embodiments 30-32, wherein at least one of the first and second connector comprises a latch for latching the connector to a mating connector.

Embodiment 34 is the connector assembly of any of embodiments 30-33, wherein the circuit board is partially disposed in the insulative housing and the mating section of the circuit board extends forwardly from the mating end of the insulative housing.

Embodiment 35 is the connector assembly of any of embodiments 30-33, wherein the circuit board is fully disposed in the insulating housing so that both the mating section and the termination sections of the circuit board are fully disposed within the insulative housing.

Embodiment 36 is the connector assembly of any of embodiments 30-34, wherein the flat cable comprises: a plurality of conductor sets extending lengthwise along the cable and arranged generally in a plane along a width of the cable, each conductor set substantially surrounded by an electrically conductive shield and including two insulated conductors, each insulated conductor comprising a central conductor surrounded by a plurality of dielectric layer; and first and second non-conductive polymeric layers disposed on opposite sides of the cable, the first and second polymeric layers including cover portions and pinched portions arranged such that, in a transverse cross section, the cover portions of the first and second polymeric layers in combination substantially surround the plurality of conductor sets, and the pinched portions of the first and second polymeric layers in combination form pinched portions of the cable on each side of the cable.

Embodiment 37 is the connector assembly of embodiment 36, wherein the shield comprises first and second shielding layers disposed on opposite sides of the cable, the first shield adhered and conforming to the first non-conductive polymeric layer, the second shield adhered and conforming to the second non-conductive polymeric layer.

Embodiment 38 is the connector assembly of embodiment 36 or 37, wherein the flat first cable further comprises an adhesive layer disposed between the first and second polymeric layers and bonding the two polymeric layers in the pinched portions of the cable.

Embodiment 39 is the connector assembly of any of embodiments 36-38, wherein the pinched portions of the first and second polymeric layers in combination form pinched portions of the cable on each side of each conductor set.

Embodiment 40 is the connector assembly of any of embodiments 30-38, wherein n is an integer ≥10.

Embodiment 41 is the connector assembly of any of embodiments 30-40, wherein the An terminals are on a left side of the respective A1 terminals.

Embodiment 42 is the connector assembly of any of embodiments 30-40, wherein the An terminals are on a right side of the respective A1 terminals.

Embodiment 43 is the connector assembly of any of embodiments 30-42, wherein the bend angle is greater than about 160°.

Embodiment 44 is the connector assembly of any of embodiments 30-42, wherein the bend angle is greater than about 170°.

Embodiment 45 is the connector assembly of any of embodiments 30-42, wherein the bend angle is about 180°.

Embodiment 46 is the connector assembly of any of embodiments 30-45, wherein each cable includes one fold extending across the entire width of the cable.

Embodiment 47 is the connector assembly of any of embodiments 30-45, wherein each cable includes three folds, each fold extending across the entire width of the cable.

Embodiment 48 is the connector assembly of any of embodiments 30-47, wherein the flat cable defines orthogonal length and width directions along the length and width of the cable, wherein in a plan view and for the cable, one of the fold lines is parallel to the length direction of the cable, and the other two fold lines make oblique angles with the length direction of the cable.

Embodiment 49 is the connector assembly of embodiment 48, wherein the oblique angles are between 30 to 70 degrees.

Embodiment 50 is the connector assembly of embodiment 48, wherein the oblique angles are about 45 degrees.

What is claimed is:

1. A connector assembly, comprising:

first and second connectors, each connector comprising:

an insulative housing comprising a mating end for mating with a mating connector and an opposing cable end for receiving one or more cables; and a circuit board at least partially disposed within the insulative housing and comprising:

an upper surface and an opposing lower surface;

a mating section at a front end of the circuit board the mating section comprising a plurality of mating terminals on each of the upper and lower surfaces for making contact with corresponding terminals of a mating connector, the mating terminals comprising A terminals A1 through An, where n is an integer ≥2, sequentially arranged on the upper surface and B terminals B1 through Bn, sequentially arranged on the lower surface, terminal Ai, for each i from 1 to n, corresponding to and aligned with terminal Bi, the A1 and An terminals of the first connector having a same positional relationship as the A1 and An terminals of the second connector; and a termination section at a rear end of the circuit board and disposed at the cable end of the insulative housing, the termination section comprising a plurality of termination terminals on each of the upper and lower surfaces electrically connected to the mating terminals; and substantially flat first and second cables comprising a plurality of electrical conductors terminated at the termination terminals of the first and second connectors such that for each i from 1 to n, terminal Ai of the first connector is electrically connected, via a different electrical conductor of the first cable, to the terminal Ai of the second connector, and terminal Bi of the first connector is electrically connected, via a different electrical conductor of the second cable, to the terminal Bi of the second connector, wherein at least one cable includes at least two fold lines that extend across an entire width of the cable, one of the fold lines being disposed above the other fold line as measured along an axis perpendicular to a width direction of the cable and to a length direction of the cable.

2. The connector assembly of claim 1, wherein the first connector is a straight connector and the second connector is a right-angle connector.

3. The connector assembly of claim 1, wherein at least one of the first and second connector comprises a latch for latching the connector to a mating connector.

4. The connector assembly of claim 1, wherein the circuit board is partially disposed in the insulative housing and the mating section of the circuit board extends forwardly from the mating end of the insulative housing.

5. The connector assembly of claim 1, wherein the mating terminals on each of the upper and lower surfaces of circuit board are arranged in a single row.

6. The connector assembly of claim 1, wherein the termination terminals on each of the upper and lower surfaces of circuit board are arranged in a single row.

7. The connector assembly of claim 1, wherein the termination terminals on each of the upper and lower surfaces of circuit board are arranged in two rows.

8. The connector assembly of claim 1, wherein some of the mating terminals are longer than some of the other mating terminals.

9. The connector assembly of claim 1, wherein at least one of the flat first and second cables comprises:

a plurality of conductor sets extending lengthwise along the cable and arranged generally in a plane along a width of the cable, each conductor set substantially surrounded by an electrically conductive shield and including two insulated conductors, each insulated conductor comprising a central conductor surrounded by a plurality of dielectric layer; and first and second non-conductive polymeric layers disposed on opposite sides of the cable, the first and second polymeric layers including cover portions and pinched portions arranged such that, in a transverse cross section, the cover portions of the first and second polymeric layers in combination substantially surround the plurality of conductor sets, and the pinched portions of the first and second polymeric layers in combination form pinched portions of the cable on each side of the cable.

10. The connector assembly of claim 9, wherein the shield comprises first and second shielding layers disposed on opposite sides of the cable, the first shield adhered and conforming to the first non-conductive polymeric layer, the second shield adhered and conforming to the second non-conductive polymeric layer.

11. The connector assembly of claim 9, wherein the at least one of the flat first and second cables further comprises an adhesive layer disposed between the first and second polymeric layers and bonding the two polymeric layers in the pinched portions of the cable.

12. The connector assembly of claim 9, wherein the pinched portions of the first and second polymeric layers in combination form pinched portions of the cable on each side of each conductor set.

13. The connector assembly of claim 1, wherein n is an integer ≥10.

14. The connector assembly of claim 1, wherein each of the first and second connectors is configured to mate with a same mating connector.

15. The connector assembly of claim 14, wherein when each of the first and second connectors mates with the same connector in a same plan view, the An and Bn terminals are on a left side of the respective A1 and B1 terminals.

16. The connector assembly of claim 14, wherein when each of the first and second connectors mates with the same connector in a same plan view, the An and Bn terminals are on a right side of the respective A1 and B1 terminals.

17. The connector assembly of claim 1, wherein the bend is greater than about 160 degrees.

18. The connector assembly of claim 1, wherein the bend is greater than about 170 degrees.

19. The connector assembly of claim 1, wherein the bend is about 180 degrees.

20. The connector assembly of claim 1, wherein each cable includes one fold extending across the entire width of the cable.

21. The connector assembly of claim 1, wherein each cable includes three folds, each fold extending across the entire width of the cable.

22. The connector assembly of claim 21, wherein the flat first and second cables define orthogonal length and width directions along the respective lengths and widths of the cables, wherein in a plan view and for each cable, one of the fold lines is parallel to the length direction of the cable, and the other two fold lines make oblique angles with the length direction of the cable.

23. The connector assembly of claim 21, wherein the bends of the first and second cable are generally located at a same position along the length of the cables.

24. The connector assembly of claim 23, wherein each cable has an average thickness D, wherein the first and second cables, in combination, form a cable stack having a fold region where the first and second cables are bent, and an unfold region on each side of the fold region where the first and second cables are not bent, wherein an average thickness of the cable stack is approximately 2D in the unfold regions, and 6D to 7D in the fold region.

25. The connector assembly of claim 24, wherein the average thickness of the cable stack is approximately 6D in the fold region.

26. A connector assembly comprising:

first and second connectors, each connector comprising a plurality of terminals A1 through An, where n is an integer ≥2, sequentially arranged in a row; and a flat cable comprising a plurality of electrical conductors electrically connecting the terminals of the first and second connectors, such that for each i from 1 to n, terminal Ai of the first connector is electrically connected, via a different electrical conductor of the cable, to the terminal Ai of the second connector, wherein the cable includes three fold lines that extend across an entire width of the cable, one of the fold lines defining a bend angle greater than about 150° and two of the fold lines forming an oblique angle with a length direction of the cable, wherein the fold line defining a bend angle greater than about 150° is disposed between the fold lines forming an oblique angle with a length direction of the cable as measured along a path of the cable, wherein each of the first and second connectors is configured to mate with a same type of mating connector, such that when each of the first and second connectors mates with the same type of mating connector in a same plan view, the An terminals are both either on a left or a right side of the A1 terminals.

27. A connector assembly comprising:

first and second connectors, each connector comprising a plurality of terminals A1 through An, where n is an integer ≥2, sequentially arranged in a row; and a flat cable comprising a plurality of electrical conductors electrically connecting the terminals of the first and second connectors, such that for each i from 1 to n, terminal Ai of the first connector is electrically connected, via a different electrical conductor of the cable, to the terminal Ai of the second connector, wherein the cable includes at least two fold lines that extend across an entire width of the cable, one of the fold lines being disposed above the other fold line as measured along an axis perpendicular to a width direction of the cable and to a length direction of the cable, wherein each of the first and second connectors is configured to mate with a same type of mating connector, such that when each of the first and second connectors mates with the same type of mating connector in a same plan view, the An terminals are both either on a left or a right side of the A1 terminals.

* * * * *